US006488119B1

(12) United States Patent
DuRapau et al.

(10) Patent No.: US 6,488,119 B1
(45) Date of Patent: Dec. 3, 2002

(54) FOLDING SAWHORSE WITH LOCKING SHELF

(75) Inventors: Rick DuRapau, Austin, TX (US); Joe Dvoracek, Latuna, CA (US)

(73) Assignee: Lehigh Consumer Products Corp., Macungie, PA (US)

( * ) Notice: Subject to any disclaimer, the term of this patent is extended or adjusted under 35 U.S.C. 154(b) by 0 days.

(21) Appl. No.: 09/634,245

(22) Filed: Aug. 8, 2000

Related U.S. Application Data

(60) Provisional application No. 60/148,522, filed on Aug. 12, 1999.

(51) Int. Cl.[7] ..... B27B 21/00
(52) U.S. Cl. ..... 182/153; 182/225
(58) Field of Search ..... 182/153, 225, 182/181.1

(56) References Cited

U.S. PATENT DOCUMENTS 5,351,785 A * 10/1994 DuRapau ..... 182/153

* cited by examiner

*Primary Examiner*—Alvin Chin-Shue

(74) *Attorney, Agent, or Firm*—Samuels, Gauthier & Stevens, LLP

(57) ABSTRACT

A folding sawhorse of the type comprising two trestle like frames that are hingedly connected at their tops. The shelf is hingedly attached to a lower strut of one frame and slidably attached to the legs of the opposite frame. The slidable attachment is by means of pairs of pins that are secured to one end of the pivoting shelf and are also yoked to longitudinal ridges that are in the legs of the opposite frame. To open the sawhorse from its closed, storage position, the frames are spread apart slightly, thereby allowing gravity to pull the shelf downwardly and concurrently causing the frames to spread outwardly to their open, working position. The sawhorse will stay in this locked open position without any additional latching mechanisms until the close procedure is initiated. To close the sawhorse for storage, a light upward pressure is applied on the edge of the pivoting shelf, causing it to move upwardly and concurrently causing the frames to pivot inwardly toward each other to their closed storage position.

6 Claims, 4 Drawing Sheets

FOLDING SAWHORSE WITH LOCKING SHELF

This application claims benefit of Provisional Patent Application Ser. No. 60/148,522, filed Aug. 12, 1999.

BACKGROUND OF THE INVENTION

This invention relates to sawhorses, scaffolds and trestles, and more particularly to a sawhorse that may be opened for use and folded to collapse for storage.

Sawhorses are used as racks or trestles to support construction materials and other objects. With their wide base, sawhorses provide a relatively stable support for a workpiece while being fairly portable. However, non-folding sawhorses require substantial space for storage and transportation.

Folding sawhorses therefore were created to solve the storage space problem and to allow for easier transportation. However, prior folding sawhorses had many shortcomings. Some prior folding sawhorses could not withstand sideways motion in the load they supported. This was particularly a problem with the type of folding sawhorse described in U.S. Pat. No. 4,884,658 to Banfield. The legs of this type of folding sawhorse that were positioned on a common side of the sawhorse were not in rigid contact with each other. The legs tended to pivot with respect to the upper central member of the sawhorse when the sawhorse was under load and therefore the sawhorse did not provide sufficient support when its load moved laterally with respect to the central supporting member.

Other folding sawhorses, such as the sawhorse described in U.S. Pat. No. 4,790,411 to Ottoson, provided significantly less vertical support than did non-folding sawhorses. The legs of these sawhorses tended to splay out under the pressure of applied weight because the sawhorse's opposing legs were not rigidly fixed to one another when the sawhorse was unfolded for use.

A folding sawhorse should readily unfold for use and fold up again for storage. Since most projects of the home owner are of short duration, if the sawhorse does not easily expand and collapse, it will be seldom used. Some folding sawhorses are both rigid and sturdy because their four legs are fixed relative to one another, but are difficult to unfold and fold.

The folding sawhorse disclosed herein is an improvement of the sawhorse disclosed in the U.S. Pat. No. 5,351,785, the disclosure of which patent is incorporated by reference in its entirety into this disclosure. The slot/sliding pin combinations of that sawhorse are replaced by a paired pin-rib engagement to provide enhanced stability.

SUMMARY OF THE INVENTION

It is therefore a general object of the invention to overcome the above described limitations and others associated with the prior folding sawhorses. More particularly, it is an object of the invention to provide a folding sawhorse that collapses or folds easily for storage and expands easily to a sturdy position for use.

To accomplish these objects, a folding sawhorse according to the invention includes a first frame, a second frame, a hinge connection between the frames, and a substantially rectangular shelf. The first frame includes a first elongated crossmember, a first pair of substantially parallel spaced apart legs extending from the first crossmember, and a first brace extending between the first pair of legs. The second frame includes a second elongated crossmember, a second pair of substantially parallel spaced apart legs extending from the second crossmember, and a second brace extending between the second pair of legs.

The hinge connection pivotally connects the first crossmember to the second crossmember so as to enable the first frame to pivot with respect to the second frame about a hinge axis. The hinge axis extends substantially parallel to the longitudinal axes of the cross members associated with both the first and second frame.

The shelf has, at a first side thereof, a slidable attachment connecting the shelf to opposing ribs formed on the first pair of legs. At a second side, the shelf pivotally connects to the second frame. In this manner, the shelf is capable of sliding along the slidable attachment and pivoting at the second side between a storage position and a working position. In the storage position the first frame lies generally parallel to the second frame with the self folded therebetween. In the working position the planes defined by the first and second frames form generally two sides of an "A" shape with the shelf forming the cross portion of the "A" shape.

In the preferred form of the invention the shelf is pivotally connected to the second frame along the second brace and rests upon both the first and second braces when the sawhorse is in the working position. Since the shelf must pivot upwardly to collapse the sawhorse, the shelf serves to hold the sawhorse firmly in the working position and prevents the sawhorse from collapsing during use. When the sawhorse is in the working position, the shelf rigidly holds the four legs in position so that they do not move with respect to one other. Such rigid positioning of the legs, coupled with the hinge connection between the rigid frames prevents relative motion among the sawhorse components to produce a sturdy rigid support structure. In the preferred embodiment the slidable attachment comprises a pair of offset pins which yoke a rib in the associated leg to provide stability.

DESCRIPTION OF THE PREFERRED EMBODIMENT

Figure 1:
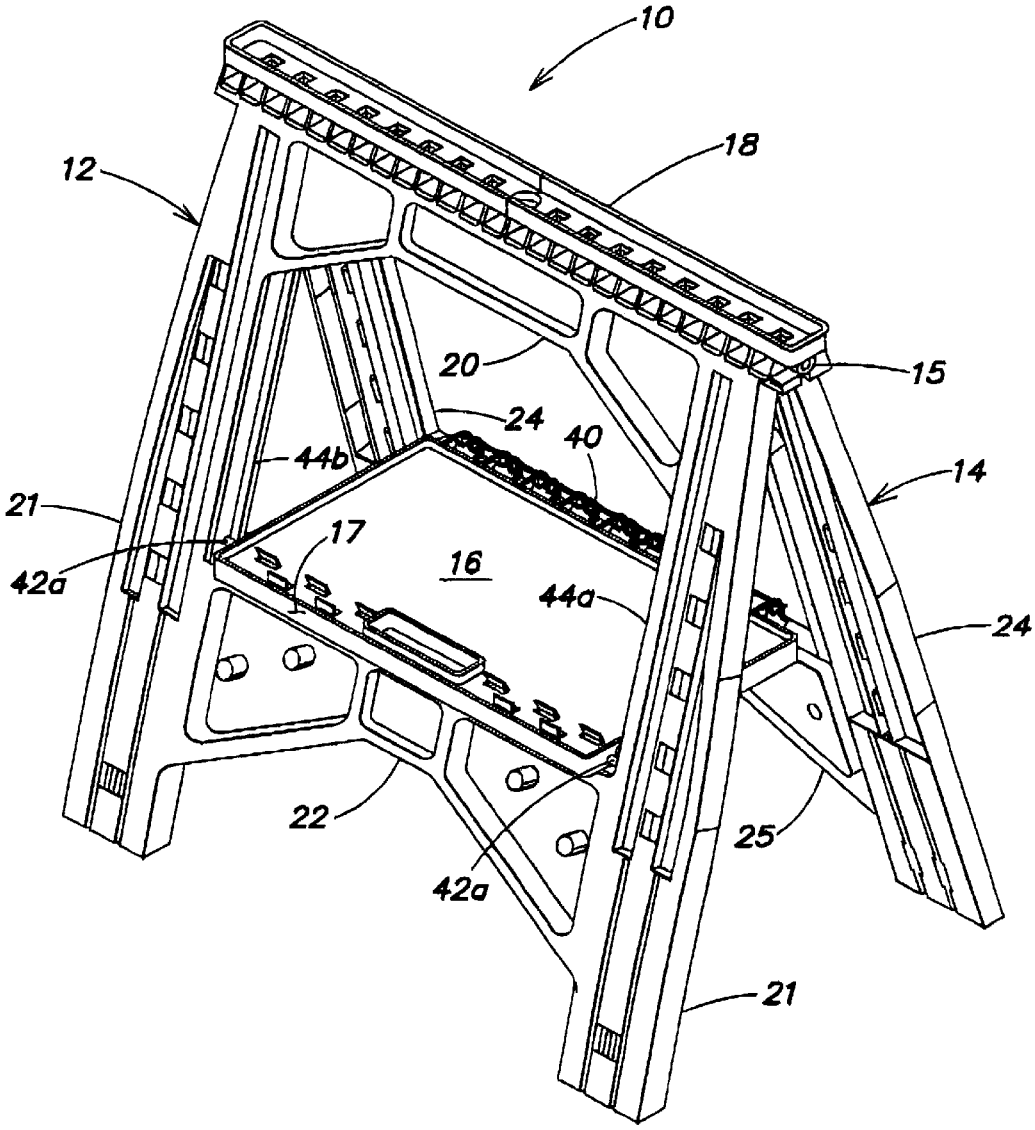
FIG. 1 is a perspective view of a folding sawhorse embodying the principles of the present invention in the working position.

A folding sawhorse embodying the principles of the present invention is shown by way of illustration in FIG. 10 and comprises a first frame 12, a second frame 14, a hinge connection 15, and a substantially rectangular shelf 16, having an edge 17. Preferably, the folding sawhorse also includes a shelf 18. The hinge connector 15 and shelf 18 is substantially as disclosed in the '785 reference, except it is one piece.

The first frame 12 comprises a first elongated crossmember 20, a first pair of substantially parallel spaced apart legs 21 extending from the crossmember 20, and a brace 22 extending between the first pair of legs. The second frame 14, identical to the frame 12, comprises a second elongated crossmember (not shown), a second pair of substantially parallel spaced apart legs 24 extending from the second crossmember, and a second brace 25 extending between the second pair of legs.

Figure 2:
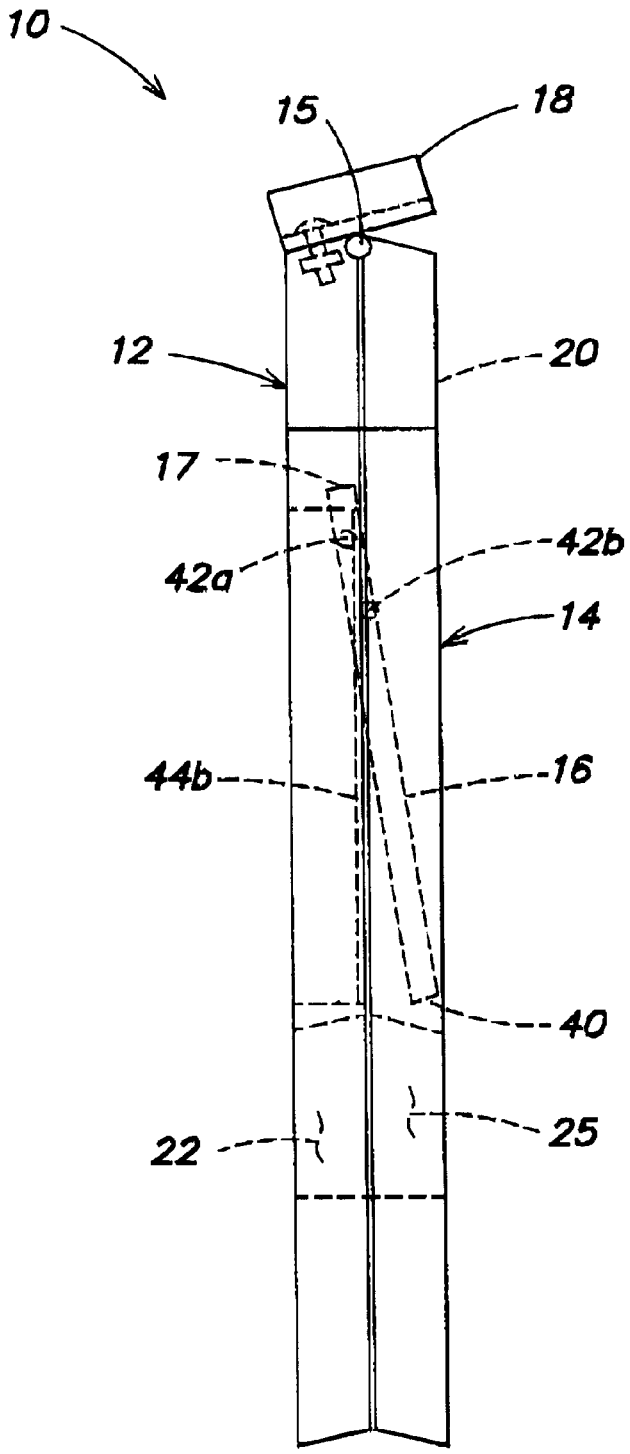
FIG. 2 is a side elevation of the folding sawhorse when in the storage position
Figure 3:
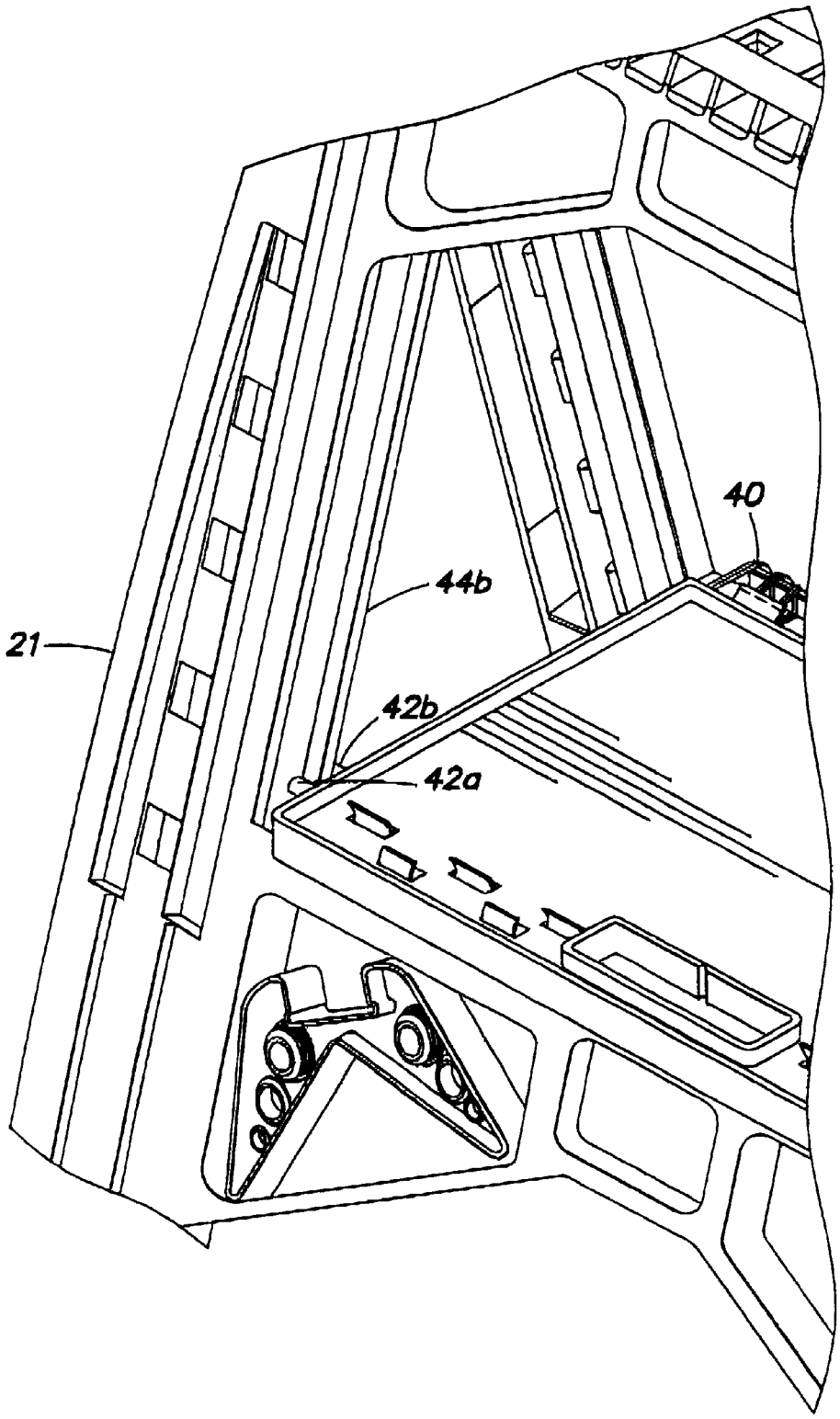
FIG. 3 is an enlarged view of FIG. 1.
Figure 4:
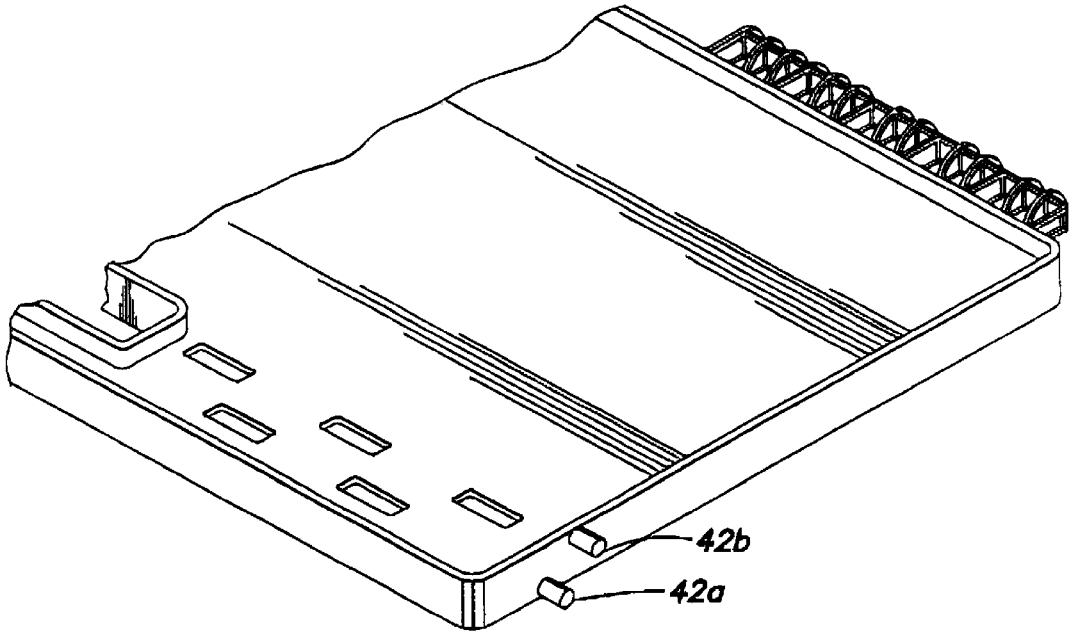
FIG. 4 is a prospective view of a pair of pins.

The hinge connection 15 pivotally connects the first crossmember 20 to the second crossmember so as to enable the first frame to pivot with respect to the second frame about a hinge axis substantially parallel to both a longitudinal axis of the first crossmember 20 and a longitudinal axis of the second crossmember. The hinge connection 15 enables the folding sawhorse 10 to move from a working position as shown in FIG. 1 to a storage position as shown in FIG. 2.

To provide rigidity and strength and to also to minimize weight and material usage, the sawhorse 10 components are preferably constructed of reinforced plastic resin molded into the desired form.

Referring again to FIGS. 1, 2, 3 and 4, the substantially rectangular shelf 16 includes, at a first side thereof, a slidable attachment comprising first and second sets of pins 42*a* and 42*b* connecting the shelf to opposing inner ribs 44*a* and 44*b* respectively formed on the first pair of legs 21.

The paired pins 42*a* and 42*b* are offset and each pair engage the ribs 44*a* and 44*b* in spaced apart relationship to stabilize the engagement of the pins to the rib (leg).

At a second side of the shelf 16, a pivot connection 40 connects the shelf to the second brace 25 such as described in the '785 reference. The shelf 16 is capable of sliding along the slidable attachment with the pins 42*a* and 42*b* traveling along ribs 44*a* and 44*b* respectively at the first side thereof and pivoting at the second side. Therefore, the shelf 16 can be easily moved from the working position, as shown in FIG. 1, to the storage position as shown in FIG. 2 by sliding the pins 42*a* and 42*b* upwardly along the ribs 44*a* and 44*b*, and pivoting the shelf 18 about connection 40.

In the working position, planes defined by the first frame 12 and second frame 14 form generally two sides of an "A" shape with the shelf 16 comprising a cross portion of said "A" shape. Further, in the working position, the first and second sides of the shelf 16 rest upon the first and second braces 22 and 25 respectively, thereby adding further rigidity to the sawhorse and supporting the shelf. In the storage position, the plane defined by the first frame 12 is substantially parallel to a plane defined by the second frame 14 and the shelf 16 folds up to lie generally flat between the first and second frames.

To collapse the sawhorse 10 from the working position as shown in FIG. 1 to the storage position as shown in FIG. 2, upward pressure is applied to shelf edge 17 thereby pivoting shelf member 16 upward and concurrently causing frames 12 and 14 to pivot inwardly towards each other. During this operation, the pins 42*a* and 42*b* affixed to the shelf 16 move upwardly along the opposing inner ribs 44*a* and 44*b* formed on the first pair of legs 21. The second side of the shelf 16 meanwhile pivots with respect to the second brace 25. The shelf 16 therefore pivots to move the sawhorse 10 from the working position to the storage position wherein the first frame 12 is substantially parallel to a plane defined by the second frame 14.

Moving the sawhorse 10 from the storage position to the working position requires pivoting the frames 12 and 14 apart about the pivot connection 40. Gravity forces the pins 42 affixed to the shelf 16 downwardly along the opposing inner channels 44 formed on the first pair of legs 21. The second side of the shelf 16 meanwhile pivots with respect to the second frame 14. Once the shelf starts pivoting downwardly, downward pressure on the shelf edge 17 continues to separate the frames 12 and 14 until the shelf reaches the horizontal position shown in FIG. 1.

The above described preferred embodiments are intended to illustrate the principles of the invention, but not to limit the scope of the invention. Various other embodiments and modifications to these preferred embodiments may be made by those skilled in the art without departing from the scope of the following claims.

We claim:

1. A folding sawhorse comprising:

(a) a first frame having a first elongated crossmember, a first pair of substantially parallel spaced apart legs extending from the first crossmember, a first brace extending between the first pair of legs and a rib on each leg;

(b) a second frame having a second elongated crossmember, a second pair of substantially parallel spaced apart legs extending from the second crossmember, and a second brace extending between the second pair of legs;

(c) a hinge connection pivotally connecting the first crossmember to the second crossmember so as to enable the first frame to pivot with respect to the second frame about a hinge axis substantially parallel to both a longitudinal axis of the first crossmember and a longitudinal axis of the second crossmember; and (d) a substantially rectangular shelf having at a first side thereof first and second sets of paired offset pins which receive respectively in sliding engagement the ribs formed on the first pair of legs and having a second side pivotally connected to the second frame, the shelf being capable of sliding along the ribs at the first side thereof and pivoting at the second side between a storage position in which a plane defined by the first frame is substantially parallel to a plane defined by the second frame and a working position in which the planes defined by the first and second frames form generally two sides of an "A" shape with the shelf comprising a cross portion of said "A" shape.

2. The folding sawhorse of claim 1 wherein:

(a) the first elongated crossmember includes a first beveled surface; and (b) the second elongated crossmember includes a second beveled surface, the first and the second beveled surfaces residing in a common plane when the sawhorse is in the working position and forming a common supporting surface.

3. The folding sawhorse of claim 2 further comprising:

an elongated top member that is removably attached to the first elongated crossmember along the first beveled surface, the elongated top member contacting the second beveled surface when the sawhorse is in the working position.

4. The folding sawhorse of claim 3 wherein:

the surface of the elongated top member contacting the first and second beveled surfaces extends beyond the first and second beveled surfaces in at least one direction.

5. The folding sawhorse of claim 1 wherein:

the shelf rests upon the first and second braces when the sawhorse is in the working position.

6. The folding sawhorse of claim 1 wherein the hinge connection includes:

(a) a first hinge body integrally formed in the first crossmember;

(b) a second hinge body integrally formed in the second crossmember; and (c) an elongated pin for pivotally connecting the first and second hinge bodies.

* * * * *